United States Patent [19]

Tinnes

[11] 4,051,589

[45] Oct. 4, 1977

[54] PROCESS AND APPARATUS FOR THE ASSEMBLY OF SLIDING GATE VALVE UNITS FOR CASTING LADLES

[75] Inventor: Bernhard Tinnes, Zollikerberg, Switzerland

[73] Assignee: Metacon AG, Zurich, Switzerland

[21] Appl. No.: 578,315

[22] Filed: May 16, 1975

[30] Foreign Application Priority Data

May 24, 1974 Switzerland ..... 7108/74

[51] Int. Cl.[2] ..... B23P 17/00

[52] U.S. Cl. ..... 29/405; 29/446; 222/600

[58] Field of Search ..... 29/405, 404, 446, 447, 29/428; 222/600, DIG. 7

[56] References Cited

U.S. PATENT DOCUMENTS

| | | | |
|---|---|---|---|
| 2,806,752 | 9/1957 | Ginn | 29/405 |
| 3,230,607 | 1/1966 | Gelzer | 29/405 |
| 3,242,026 | 3/1966 | Saxton et al. | 156/272 |
| 3,511,261 | 5/1970 | Bick et al. | 222/600 |
| 3,567,082 | 3/1971 | Tinnes | 222/DIG. 7 |

FOREIGN PATENT DOCUMENTS

| | | | |
|---|---|---|---|
| 677,638 | 1/1966 | Belgium | 29/401 |

*Primary Examiner*—Charlie T. Moon
*Assistant Examiner*—Daniel C. Crane
*Attorney, Agent, or Firm*—Cushman, Darby & Cushman

[57] ABSTRACT

For a foundry ladle provided with a sliding gate valve to be removed from the ladle as a unit to permit replacement of worn-out refractory material, there is provided a process and apparatus for assembly of the sliding gate valve unit in upright position, while the parts of the sliding gate valve unit are subjected to heating.

3 Claims, 3 Drawing Figures

PROCESS AND APPARATUS FOR THE ASSEMBLY OF SLIDING GATE VALVE UNITS FOR CASTING LADLES

FIELD OF THE INVENTION

The invention relates to a process and an arrangement for the assembly of sliding gate valve units for casting ladles.

BACKGROUND OF THE INVENTION

Traditional sliding gate type valves can be divided into (a) a valve housing which also contains the driving means beside the bed plate, and (b) the movable slide part with valve plate and discharge nozzle. The valve housing is firmly secured onto the bottom of the ladle. The movable slide part is pressed by way of a stationary lid and by means of clamping bolts against the bed plate with a force such that on the one hand the movable slide part does not jam and on the other so that emergence of the liquid metal between the contact surfaces of the bed plate and of the slide plate under the influence of the ferrostatic pressure will be prevented, especially in the case of a full ladle.

Recently, sliding gate valves have become known, which constitute a unit, containing all the parts necessary for the fulfillment of its function as a valve for controlling the flow of molten metal out of the ladle. Such unitary sliding gate valves are designed to be releasably connected with the casting ladle, for example by means of bolts and wedges, that is to say in a simple manner. The advantage of these valve units lies in the fact, that an overhauling, that is to say the removal and replacement of worn-out refractory parts and the reassembly need not be accomplished in the steel plant, but may be carried out in a central preparatory area. When the unit is removed from the ladle, the nozzle brick insert will remain in the ladle.

The present invention bases on the realization that the temperature conditions of the sliding gate valve unit and its parts that are to be assembled, during tightening of the clamping bolts between the lid and the housing, are of essential importance for the proper operation of the slide.

Therefore it is the aim of the invention to provide an improved process for the assembly of casting ladle slide valve units.

SUMMARY OF THE INVENTION

The process according to the invention is distinguished by the fact, that parts of the gate valve unit are heated to a predetermined temperature while in disassembled condition, that the gate valve unit is then assembled while said parts are in their heated state and that the pre-tension of the lid is adjusted to a predetermined value while at a predetermined elevated temperature.

The invention provides the advantage of carrying out the assembly of the sliding gate valve under controllable temperature conditions. As a result, the pre-tension force is assuredly constant from case to case, and thus the contact pressure between the bed plate and the slide plate is maintained at a value desired under operating conditions.

The invention also relates to an arrangement for carrying out this process, which arrangment is distinguished by a mounting frame which has heating means in addition to the attaching means for the valve housing, which heating means faces the ladle side of the valve housing.

Preferably the support for the ladle side of the valve housing is disposed vertically, so that the valve housing is attached in a perpendicular position to the mounting arrangement and the assembly is accomplished in this position.

The basic advantage of the assembly in a perpendicular position is that it provides more comfortable working conditions. In comparison, a horizontal position of the sliding gate valve unit would mean that the personnel occupied with the mounting would have to assume a forward bending position over their work and would be exposed to a considerably greater heat radiation load.

A further advantage of the invention consists in the fact, that the mortar which is necessary for the insertion of the bed plate into the housing will set quickly, and therefore may be subjected to pressure loads without loss of time, so that the insertion of the movable slide part therefore can take place immediately after the bed plate has been inserted.

BRIEF DESCRIPTION OF THE DRAWINGS

The process according to the invention will be explained subsequently in an embodiment given by way of example and on the basis of drawings showing said arrangement.

In the drawings

DETAILED DESCRIPTION

Figure 1:
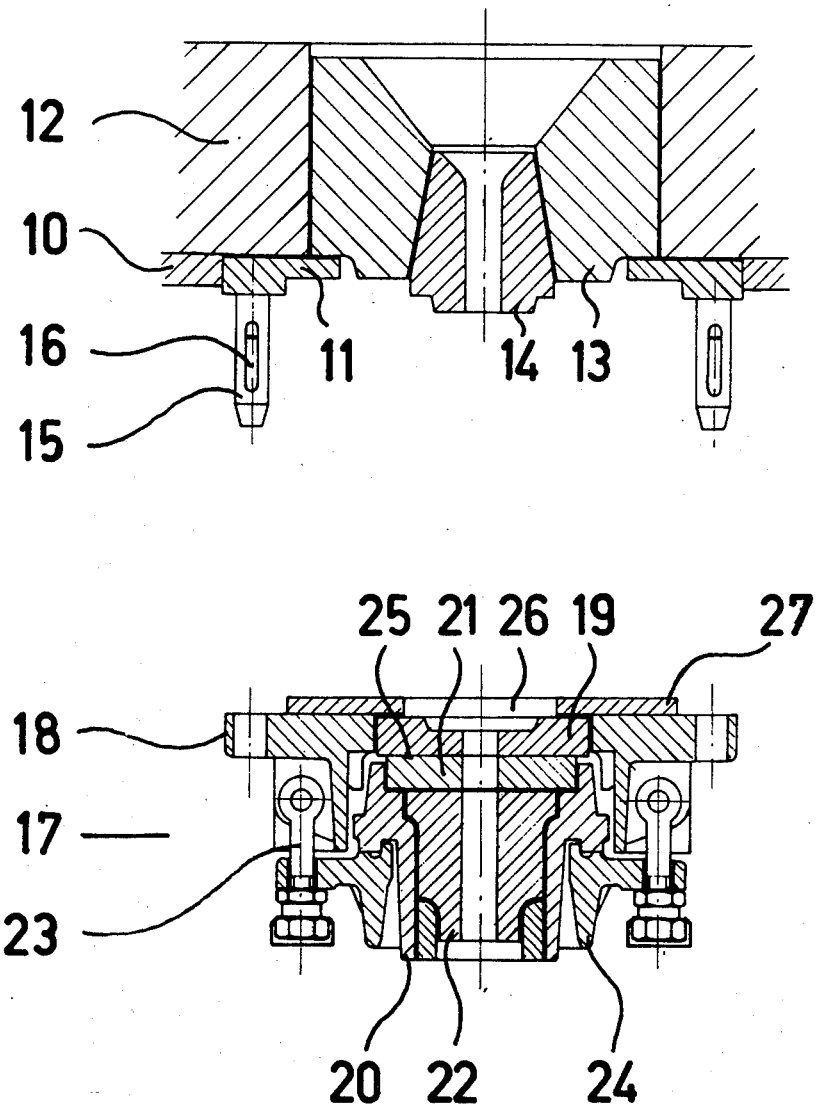
FIG. 1 shows a cross section through a unit type sliding gate valve separated from the bottom of a foundry ladle shown in fragmentary cross section.

In FIG. 1, the bottom of a casting ladle is designated by 10, which has a base plate 11 as a reinforcement. A nozzle brick 13 is walled into the refractory fire-resistant lining 12 of the casting ladle in which a replaceable nozzle brick insert 14 is located. The base plate 11 carries bolts 15 which serve for the purpose of attaching the sliding gate valve unit to the ladle with the aid of wedges 16. The valve unit 17 consists in the main of a valve housing 18, with a bed plate 19 inserted into a bed of mortar in the valve housing, and the movable slide part 20 with a slide plate 21 and a discharge nozzle 22, which likewise are embedded in the mortar. With the aid of the clamping bolts 23, a contact pressure force is produced which is transferred from the lid 24 to the movable slide part 20 and finally to the contact surfaces 25 of the bed plate 19 and the slide plate 21. Means for effecting relative movement of the bed plate 19 and the slide plate 21 are not shown.

Figure 2:
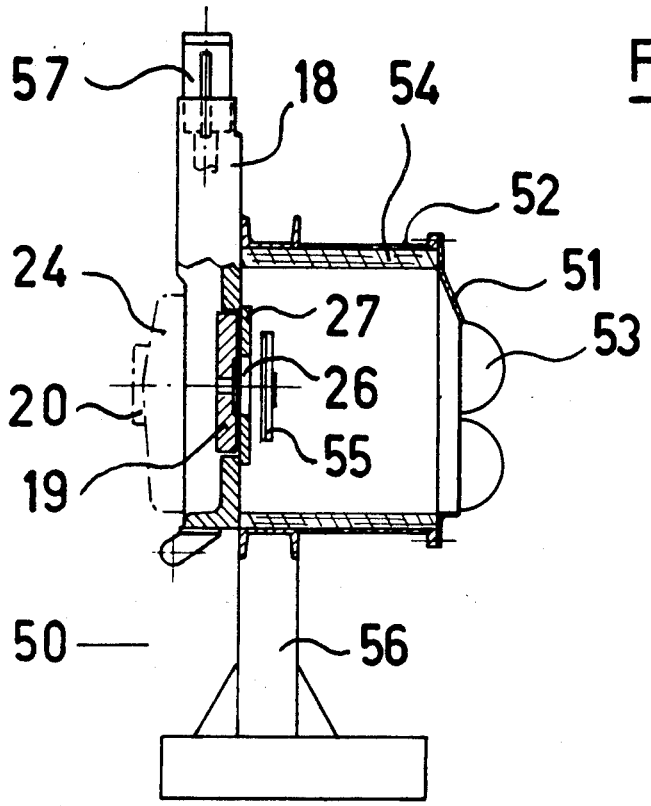
FIG. 2 is a vertical sectional view through a mounting frame with a valve housing attached to it; while the valve unit is being reassembled in a heated state
Figure 3:
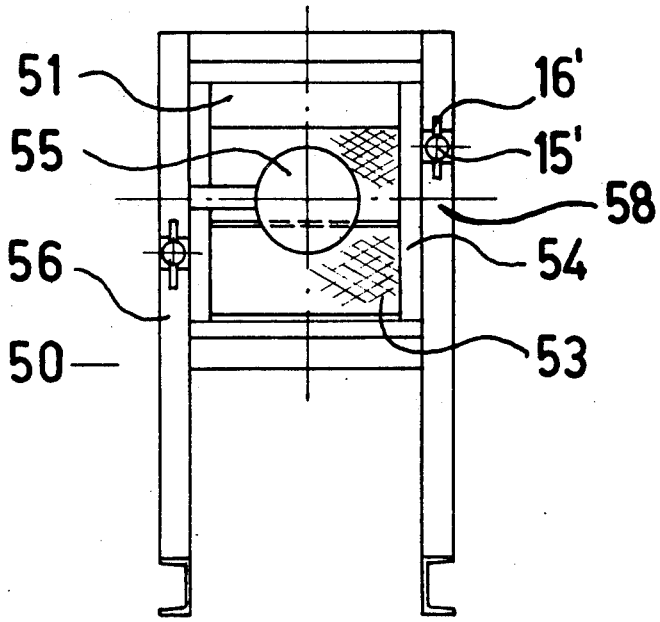
FIG. 3 is a front elevation view of the mounting frame according to FIG. 2, however without the valve housing.

In the FIGS. 2 and 3, the numeral 50 generally designates a work support means which includes a mounting frame 56. On the rear wall 51 of a box 52 which is attached to the frame 56, a heating device 53 is provided.

The box 52 is provided with an insulation 54 on the inside of its bounding wall, which insulation will reduce heat losses. Infrared radiators have been shown as a heating device 53, the heating capacity of which is adjustable. Naturally other heating means such as electric heating bars, gas burners, oil burners, etc. could be used. The rear wall 51 and the heating device 53 are removable and replaceable.

The mounting frame 56 does not necessarily have to be stationary. In a suitably modified form it may also be disposed on a revolving table or on a transportation or conveyor means which is movable, for instance along a track.

The mounting frame 56, includes a contact surface 58, and in addition has attaching means in the form of bolts 15' and wedges 16' for the valve housing, identical with those shown in FIG. 1 on the ladle. Consequently, the valve housing 18 may be attached to the mounting frame 56 in such a way that the ladle side of the valve housing resting on the mounting surface 58 faces the heating device 53. In the illustration according to FIG. 2, the assumption has been made that the stage of reassembly is such that the movable slide part 20 and the lid 24 have not yet been mounted on the valve housing 18. The state as shown thus corresponds to that after the insertion of the bed plate 19.

A metal sheet 55, attached to the frame 56, is provided for protection against thermal radiation. It covers up the aperture 26 in the supporting ring 27 and thus prevents premature heating up of the exposed ladle side of the bed plate 19.

If the bed plate 19 is inserted while the valve housing 18 is in the heated state, the mounting of the movable slide part 20 by means of the lid 24 and the clamping bolts 23 on the slide housing may take place practically immediately afterwards, since the mortar will set very quickly under the influence of heat. At the same time it is of importance for the invention, that the mounting of the slide part 20 and preferably of the lid 24 takes place in a heated state at a predetermined temperature and that the tightening of the clamping bolts or nuts is carried out to a predetermined torque, while these parts as well as the valve housing with its inserted bed plate all have the said predetermined temperature. The mounting of the parts is carried out with the heating device 53 operating.

As has already been indicated, the slide plate 21 and the discharge nozzle 22 are secured in the slide part 20 by means of conventional mortar joints. Since slide plate 21 and discharge nozzle 22 are both made of refractory material and require replacement at the same time when the bed plate 19 is being replaced, the new mortar joints must again be made to set under heat once the refractory parts 21 and 22 have been placed in the slide part 20 and prior to the mounting of the latter in the valve housing. Preferably a conventional heat setting or drying oven (not shown) is provided in order to carry out the heat setting of these mortar joints.

As has already been indicated, the slide part 20 is to be mounted in the valve housing 18 in heated condition. In order to obtain this heated condition of the slide part 20, it is removed from the heat setting oven where the mortar joints were heat set only immediately prior to the assembly of the sliding gate valve unit.

The preheating temperature at which the valve unit parts are assembled depends on the temperature load of the sliding gate valve unit during its expected use on the ladle, that is to say on the time of use and on the intensity of possible heat radiation from the outside. As a rule an average preheating temperature of 120°–200° C had been sufficient in order to arrive at a pretensioning torque which can be adjusted with sufficient precision. During the pretensioning of the sliding gate valve unit, a hydraulic cylinder-piston-unit (57 in FIG. 2) is connected to the movable slide part 20. The force, with which the slide part 20 can still be moved safely is a measure for the pretensioning force that is to be effective and thus for the maximum torque which may be applied on the bolts 23. Since the mean preheating temperature during pretensioning corresponds approximatey to the mean temperature of the valve unit in operation, the contact pressure at the contact surfaces 25 produced in this manner may safely be assumed to be correctly in order to exclude both a jamming of the movable slide part 20 as well as breakthrough of liquid metal between the plates 19 and 21 when the valve unit is in use on the casting ladle.

It should now be apparent that the process and apparatus for the assembly of sliding gate valve units for casting ladles as described hereinabove, possesses each of the attributes set forth in the specificaton under the heading "Summary of the Invention" hereinbefore. Because the process and apparatus for the assembly of sliding gate valve units for casting ladles of the invention may be modified to some extent without departing from the principles of the invention as they have been outlined and explained in this specification, the present invention should be understood as encompassing all such modifications as are within the spirit and scope of the following claims.

I claim:

1. A process for assembling a sliding gate valve unit including a valve housing and slide part for a casting ladle, comprising:

with the unit separated from the ladle and in a substantially disassembled condition, a. heating the valve housing and slide part to an elevated temperature approximately corresponding to the mean temperature of the unit when in use on a casting ladle, the heating step including applying radiant heat to the valve housing;

b. mounting the slide part to the valve housing with a fastening means and c. tightening the fastening means to the extent needed to provide a predetermined degree of tightness between the slide part and the valve housing, all while these parts remain heated;

the unit, when assembled, including a bed plate set in mortar, in the valve housing the process further including:

applying mortar to the bed plate;

setting the bed plate in the valve housing while the valve housing remains heated, before performing step (b) and permitting the mortar to set at elevated temperature;

mounting the valve housing on edge so that it faces sideways for the performance of steps (a), (b) and (c), the mounting step further including:

mounting the valve housing on a frame having an oven enclosure, with the ladle side of the valve housing facing into the oven and with the opposite side thereof accessible from exteriorly of the oven.

2. The process of claim 1, wherein:

the tightenin step further includes:

reciprocating the slide part after the tightening step has been begun to provide a way of dynamically assessing whether the predetermined degree of tightness has been achieved.

3. The process of claim 1, wherein:

the fastening means includes a lid, and the tightening step includes securing the lid to the valve housing with bolts and tightening the bolts to clamp the slide part between the lid and the valve housing.

* * * * *